United States Patent [19]

Klee et al.

[11] Patent Number: 4,627,197

[45] Date of Patent: Dec. 9, 1986

[54] PROCESS CONTROL FOR CRYOGENIC DECOATING

[75] Inventors: David J. Klee, Emmaus; Thomas W. Burke, Allentown, both of Pa.; Scott A. Miller, Lexington, Mass.

[73] Assignee: Air Products and Chemicals, Inc., Allentown, Pa.

[21] Appl. No.: 559,522

[22] Filed: Dec. 8, 1983

[51] Int. Cl.[4] ..... B24C 1/00

[52] U.S. Cl. ..... 51/319; 51/322; 51/416

[58] Field of Search ..... 51/319, 320, 321, 314, 51/315, 322, 416; 241/18, 23, 65, DIG. 37; 134/40; 62/65

[56] References Cited

U.S. PATENT DOCUMENTS

| | | | |
|---|---|---|---|
| 1,978,204 | 10/1934 | Hurt | 241/DIG. 37 |
| 3,313,067 | 4/1967 | Smith et al. | 51/330 |
| 3,468,077 | 9/1969 | Jones et al. | 51/314 |
| 3,528,201 | 9/1970 | Jones et al. | 51/164 |
| 3,824,739 | 7/1974 | Moret et al. | 51/322 |
| 3,934,379 | 1/1976 | Braton et al. | 51/319 |
| 4,020,992 | 5/1977 | Binder et al. | 241/18 |
| 4,251,034 | 2/1981 | Corr et al. | 241/23 |
| 4,312,156 | 1/1982 | McWhorter | 51/418 |
| 4,355,488 | 10/1982 | Schmitz et al. | 51/319 |

*Primary Examiner*—Frederick R. Schmidt
*Assistant Examiner*—Robert A. Rose
*Attorney, Agent, or Firm*—James C. Simmons; E. Eugene Innis

[57] ABSTRACT

Operation of processes for removal of adherent coatings from articles by cryogenic embrittlement of the coatings and blasting of the embrittled coatings with impact media impelled by one or more rotating throwing wheels in a closed treating chamber are disclosed, wherein the chamber is initially cooled down progressively to a supercold preset temperature level considerably below that required for embrittlement of the coatings. In a preferred batch operation the throwing wheel or wheels are rotated in the absence of media fed thereto during an initial stage of the operating cycle. The supercold preset temperature level is controllably maintained for a prefixed time period for prechilling the coated articles. At the end of said prechilling preset time period the blasting of the coated articles is initiated. The blasting is continued for a fixed time period; during part of said blasting time period the temperature of the chamber is permitted to rise to a second preset level and while continuing the blasting the introduction of refrigerant into the vessel is discontinued.

14 Claims, 3 Drawing Figures

PROCESS CONTROL FOR CRYOGENIC DECOATING

TECHNICAL FIELD

The present invention relates to cryogenic systems for impact blasting of coated articles.

BACKGROUND OF THE INVENTION

It is a known technique to remove flash from molded articles and paint or other coatings from various articles by contact with a chilling medium at low temperature effecting the embrittlement of the flash or coating, thereby facilitating removal of the flash or coating by impact.

In certain of such systems the impact is effected by tumbling the embrittled articles in a rotating drum. Such a system is illustrated in U.S. Pat. No. 3,468,077, as applied to deflashing of molded articles.

The removal of layers of surface coatings of organic material built up on a support, by embrittlement of the coating to lessen the bonded relation between the support and the built up layers, is disclosed in U.S. Pat. No. 3,934,379. The patent indicates that the embrittled coating may be separated from the support by abrasion or impact. No particular form of apparatus is illustrated in the patent, but the embrittlement is described as being carried out by full or partial immersion of the coated article in a bath of liquefied gas, or by spraying the liquefied gas directly on the article. Removal of the embrittled coating can then be effected by means of a blast of abrasive material directed thereon by a conventional air gun or by using a known type of centrifugal wheel hurling abrasive particles, such as sand or metal shot, radially outwardly at high velocity. For thick layers of coating the patent advocates impact of the embrittled coating by striking with a hammer or the like.

Low temperature processes and systems for deflashing of molded resilient articles by physical impact of the embrittled flash are known in the prior patent art. In U.S. Pat. No. 3,468,077, removal of the selectively embrittled flash is preferably effected by drum tumbling, with the suggestion that the temperature control instrumentation therein disclosed may be used to control other types of mechanical deflashing means such as shot peening and vibrating equipment. Specific systems for flash removal from cryogenically precooled articles by shot blasting are disclosed more particularly in U.S. Pat. Nos. 4,312,156 and 4,355,488. A preferred blasting medium is pelleted polycarbonate resin, as disclosed in U.S. Pat. No. 3,313,067.

In typical operation of such systems the articles to be treated are introduced or placed into a thermally insulated chamber maintained at the required low temperature effecting the desired embrittlement of the portions to be removed and the stream of blasting media is centrifugally impelled at high velocity against these articles by one or more rotating impellers or so-called throwing wheels. The discharged blasting media together with the fragments of flash or coating material removed thereby, are collected and conveyed out of the treating chamber to a screening apparatus in which the blasting media is separated and recovered for recycling to the blasting operation, while the larger fragments of the removed flash or coatings as well as the fines are discharged.

While there are certain features had in common in systems for removal of coatings as well as in systems for deflashing, each of these operations presents its individual problems, as will appear below.

Improvements in systems designed more particularly for coating removal by embrittlement and blasting with impact media are disclosed, for example, in pending patent applications. Ser. No. 445,778 filed Nov. 30, 1982 and in Ser. No. 461,087 filed Jan. 26, 1983.

In the case of deflashing of molded articles the composition of the flash is not different from that of the body of the article, so that the selective embrittlement of the flash depends upon the relative thinness of the flash portion. In the case of coated articles the tenaciously adhering layers of the coating bear no significant relation to the composition of the supporting base to which these are bonded. The thermal contraction of organic coatings is much greater than that of metallic structures bearing such coatings when they are both cooled to the same temperature. However, when a coated article is cooled very rapidly, the coating will be substantially colder than the article itself. Thus, to maximize the differential thermal contraction, it is necessary to achieve the fastest possible cooling rate of the coated articles. This can be accomplished by subjecting the article to the lowest possible temperature and by increasing the heat transfer coefficient on the surface of the coated article.

After the bonding interface between the coating and the article has been weakened by the shear stress produced by differential thermal contraction, the coating is removed by impacting the surface with high velocity media. When the coating is breaking away from the article during this phase of the process, the coating can be removed more easily if the material is at or below its embrittlement temperature. However, for most coating materials the embrittlement temperature is significantly warmer than the temperature utilized during the very rapid cooling phase. Thus, to minimize the consumption of refrigerant, such as liquid nitrogen (LIN), it is desirable to operate the media blasting phase of the cycle at a warmer temperature. Finally, when the coating removal phase is partially completed, further reduction in consumption of refrigerant can be had by shutting off the input of LIN.

The conventional process control for cryogenic coating removal has several disadvantages that limit the productivity of the system and lead to increased consumption of refrigerant. In these conventional systems an automatic cycle is utilized, wherein a timed prechill period is initiated by the operator by energizing the system. During this period the cryogenic liquid refrigerant is injected into the treating chamber to lower the chamber temperature to a preset value, maintained by a temperature controller. When the set prechill period is completed, a media blast timer and a cycle temperture timer are energized. During the time period preset for the media blast, the throwing wheels and the media feeders are operated to impact the coated articles with high velocity particles, during which period the temperature controller continues to maintain the preset temperature level in the chamber. When the set cycle temperature time period is completed, the supply of LIN to the treating chamber is discontinued but the blasting of the coated article with media is continued for the additional preset time period. At the completion of such additional blasting period, the automatic cycle is completed, the system stops its operations, and the chamber may be unloaded. These conventional cryogenic coating removal systems employ a fixed time period for prechilling the workpieces and a fixed period in the operating cycle during impacting, both operated at a single constant temperature environment.

In these conventional systems, the time required to lower the chamber temperature to the preset value will vary for a number of reasons. The cooldown of the treating chamber, the chamber insulation, the media, the media separator and the media feeders, is a profressive process requiring six to nine cycles to reach a constant time period. Thus, the initial cycles will experience a warmer temperature-time profile resulting in incomplete coating removal. When the system reaches the constant cooldown time period after many cycles, the automatic cycle will be longer than necessary, thus wasting refrigerant and production time. During the progressive system cooldown, the operator should continually readjust the prechill time period. The cooldown time will also be affected by the saturation condition of the LIN or other refrigerant in the storage tank from which it is supplied to the treating chamber. Thus, for example, as the LIN storage tank pressure increases, the available refrigeration capacity of the LIN will decrease, causing the cooldown time to vary. Further, as the size of the workload increases, the cooldown time will also increase. The many variations in the temperature-time profile encountered by the coated articles will cause erratic and inconsistent decoating results.

Many of the disadvantages encountered in the conventional control applied to the design and operation of cryogenic decoating systems, stems from the fact that such control is based on process control arrangements utilized for the deflashing of molded articles. The deflashing process requires cooling of the thin flash to just below the embrittlement temperature and impacting the brittle flash with high velocity media. However, if the molded article is subjected to a substantially colder temperature, cracking and product damage will result. Since the cooling rate will be short of maximum when the treating chamber is just below the temperature of embrittlement, the decoating process is retarded and the coating must be mechanically abraded by the media blast. The longer cycle time thus required will decrease the productivity of the system and increase consumption of refrigerant.

Among the objectives of the present invention is the provision of a process control system wherein the cryogenic removal of coatings by embrittlement and impact can be operated at improved efficiency, overcoming certain of the disadvantages experienced in conventional prior art systems and obtaining significantly higher productivity while reducing consumption of refrigerant.

SUMMARY OF THE INVENTION

In accordance with the present invention an automatically controlled operating cycle is provided for removal of bonded coatings from their supports by embrittlement of the coatings and blasting with impact media projected by rotating bladed impellers, wherein during the operating cycle the coated article is (1) initially subjected to a progressively decreased temperature environment until such environment reaches a first preset lowest temperature level while introducing cryogenic fluid refrigerant into the treating chamber to effect initial cooldown of the chamber. When such first preset temperature is reached, the environment is (2) controlled to maintain such first preset temperature level substantially constant during a preset fixed time period. At the end of said preset time period during which the coated article is being prechilled, (3) blasting of the coated article with impact media is initiated and continued for a fixed preset blasting time period. During the blasting period, (4) introduction of refrigerant into the chamber is continued during a fixed major portion of the blasting period while the temperature of the chamber is permitted to rise to a second preset temperature level, at which level the chamber is maintained at substantially constant temperature for the remainder of said major portion of the fixed blasting period. At the expiration of remaining time at said constant temperature level, (5) the introduction of cryogenic fluid into the chamber is discontinued while blasting is continued for the remainder of said media blast period. Preferably during the initial period during which the treating chamber is being cooled down and during the fixed period of prechilling the coated articles, the rotary bladed impellers are operated in the absence of impact media to obtain rapid recirculation of the introduced refrigerant, thereby inducing forced convection heat transfer at the surfaces of the coated articles.

The particulars of the invention will be fully understood from the description which follows, read in connection with the accompanying drawings.

DETAILED DESCRIPTION

Any of the known types of apparatus heretofore employed or adapted for use in the treatment of coated articles by cryogenic embrittlement and high velocity impact with blasting media, may be used in practice of the present invention, when suitably modified to incorporate the instrumentation needed for control of the various steps of the process cycle in accordance with the invention. Among preferred types of apparatus there are included such batch operating systems as are shown and described in the aforesaid pending U.S. patent application Ser. No. 445,778 filed Nov. 30, 1982 and Ser. No. 461,087 filed Jan. 26, 1983.

Figure 1:
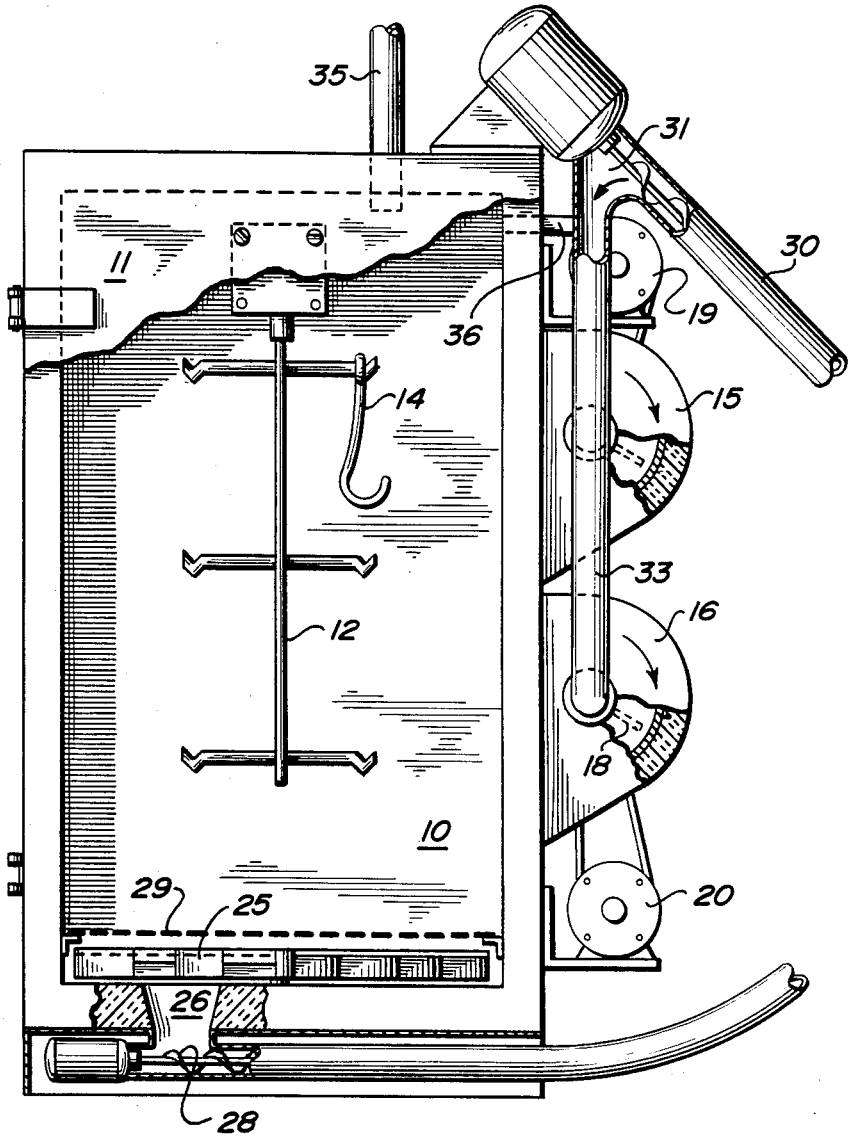
FIG. 1 is a simplified front elevation of a preferred form of apparatus that may be employed in practice of the invention in batch mode, with parts being broken away and shown in section.

One type of apparatus for batch operation is illustrated in FIG. 1 of the accompanying drawings.

The apparatus of FIG. 1 comprises an insulated treating chamber 10 equipped with a hinged door 11. A device for holding coated articles during treatment is provided within chamber 10. In the illustrated embodiment, such holder is shown in the form of a suspending rack 12 on which the coated articles 14 are hung. Rack 12 may be suspended from the roof of the chamber or from a horizontal beam extending into the chamber and attached to the inner face of door 11. Preferably rack 12 is rotatably mounted and provided with means (not shown) to rotate the rack.

The apparatus includes one or more throwing wheels for blasting the coated articles with the impact media. While not limited thereto, in the embodiment illustrated, two such wheels 15 and 16 are shown, communicating at spaced levels within the interior of chamber 10 through openings at the sidewall at which these wheels are mounted. The throwing wheels are of known design, each having a plurality of fan blades 18 rotated in a vertical plane by appropriate drive means such as shown at 19 and 20. Door 11 extends substantially the full height of chamber 10, permitting full use of the chamber without obstruction.

The used blasting media, together with refuse comprising the removed coating fragments, fall to the bottom of chamber 10 and are conveyed by suitable means such as a rotating rake 25, into a chute 26 at an opening in the floor of chamber 10, and fed into the inlet end of a screw conveyor 28. A grate 29 is supported above the top surface of rake 25 to prevent entry of large fragments of refuse into conveyor 28.

As is conventional in known throwing wheel systems, the mixture of refuse and used media is transported by conveyor 28 to a higher level feeding into a screening device (not shown) and the clean reusable media is recovered for reuse. The recovered media (together with any added makeup) is transported by a screw conveyor 30 to a discharge level or transfer area 31, at which the media is discharge into tubular feed chutes, such as shown at 33, discharging into the rotating wheels 15 and 16, respectively, through laterally disposed feed conduits.

The refrigerant may be introduced into chamber 10 at any convenient point or points (not shown) from a supply tank for the cryogenic liquefied gas and under automatic control by a suitble valve arrangement. Gas is vented from chamber 10 by a line 35 communicating with the interior of the chamber.

In systems wherein assist gas is employed for moving the media through the laterally disposed feed conduits discharging into the throwing wheels, all or part of such assist gas may be obtained, as shown in FIG. 1, by withdrawing gas from chamber 10 through a duct 36 passing through an opening in the side wall of the chamber at which the wheels 15 and 16 are mounted. The gas so withdrawn is supplied to the laterally disposed conduits and is drawn into and through these conduits by the suction created by the rotation of the respective throwing wheels.

Any of the various types of known blasting media heretofore use may be employed in practice of the invention, such as pelletized steel or plastic shot, hard minerals or the like. The refrigerant may be any nonreactive gas or vapor at a temperature such that the coating to be removed is embrittled thereby in the treating chamber. The refrigerant may be introduced in precooled gaseous form or as a liquefied gas, such as liquid air or LIN, sprayed into the treating chamber and vaporized by expansion therein.

Two factors are at work in cryogenic coating removal. The first of these is the cooling of the coating below the glass transition temperature so that it shatters upon impact. The second factor is the mechanical stress created in the coating due to the difference in coefficients of thermal expansion of the coating and the underlying metal. Since the coefficient of thermal expansion for the metal is less than that of the organic coating, as they are cooled a shear stress is generated at the bonding interface between the coating and the article. If the coating is cooled to a temperature below that of the metal, the resulting shear stress will be even greater.

By operation in accordance with the present invention, the most rapid cooling of the coating is effected, so that not only is the difference in the coefficients of thermal expansion of the two materials effective in generating shear stress at the bonding interface, but also the maximum temperature difference between the coating and the underlying metal is maintained. More rapid cooling than that achieved in the conventional cryogenic decoating operation is attained by first lowering the temperature of the treating chamber to a level substantially below that normally employed, i.e., far below the embrittlement temperature of the coating. The heat transfer coefficient at the surface of the coating is increased at a more rapid rate by circulating cold gas through the chamber and over the work by activating the throwing wheels at the beginning of the cycle and before impact of the coated article with the blasting medium.

Figure 2:
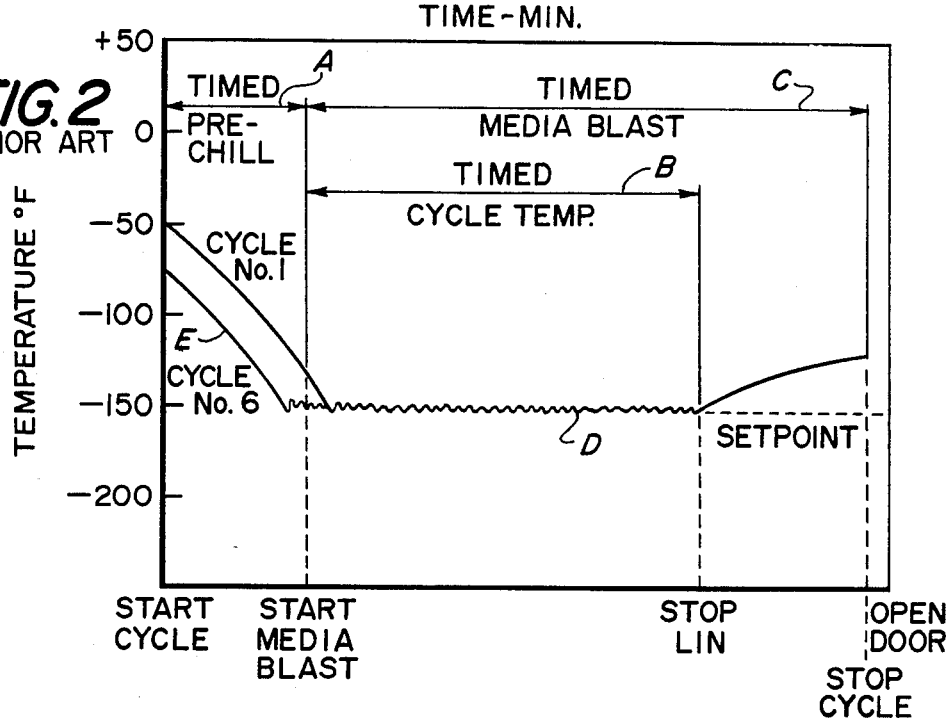
FIG. 2 PRIOR ART
FIG. 2 is a plot of the temperature profile had in a typical system for cryogenic embrittlement and removal of bonded coatings from their supports, operated under a conventional process cycle control system.

In the conventional systems for coating removal by impacting the embrittled coating, as seen from the temperature profile plotted in FIG. 2, during the initial cycle at startup the articles to be decoated are introduced into the treating chamber, which as shown, may be at a temperature of about minus 50° F. (−46° C.). During a preset fixed holding period (designated "timed prechill", represented by dimensional line A) with continuous introduction of cryogenic refrigerant, the chamber will cool down to a preset temperature level in the order of about minus 150° F. (−101° C.), at which level the blasting of the workpieces with impact media is started and that set temperature level maintained for a fixed time period (designated "timed cycle temperature" represented by dimensional line B). The timed cycle temperature period generally constitutes about 45 to 55% percent of the total residence time of the workpiece in the treating chamber. At the expiration of the set time period B, flow of refrigerant (LIN) is discontinued while blasting of the workpieces is continued for an additional period of time. The total time that the articles are being blasted, designated "timed media blast" is represented by dimension line C. At the expiration of the set time period C the cycle is stopped. A short time thereafter the door is opened and the decoated articles are removed from the treating chamber, making room for introduction of fresh workpieces to start a second cycle. During the period of time measured between the right end terminus of line B ("stop LIN") and the right end terminus of line C ("stop cycle") the temperature of the treating chamber will rise some 40° to 50° F. (22° to 28° C.) from the set level indicated by line D.

With the beginning of each new cycle the starting temperature of the treating chamber is progressively lower. Thus, at the beginning of the sixth cycle, as shown by line E of FIG. 2, the chamber is precooled to the set running temperature of line D in a shorter time period than was required in preceding cycles. Thus, if the prechill time is fixed as shown by line A, the initial cycle will experience a warmer time-temperature profile resulting in incomplete coating removal. When the system, on many repeated cycles, reaches the constant cooldown time period, the automatic cycle will be longer than necessary, thus wasting refrigerant and production time.

Figure 3:
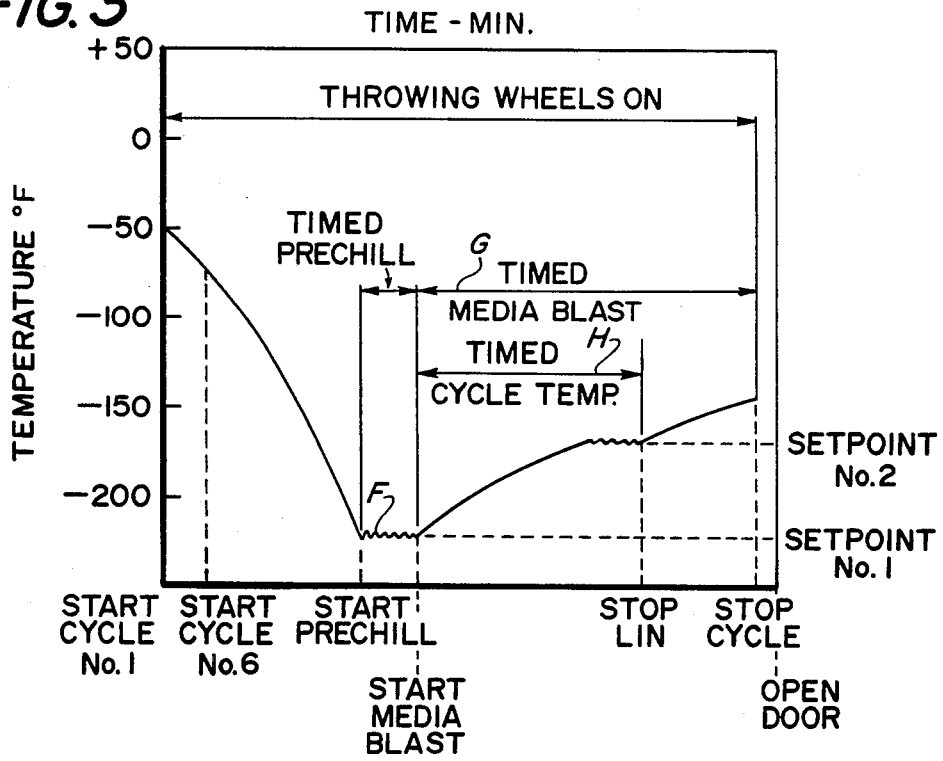
FIG. 3 is a plot of the temperature profile obtained in a similar system operating under the improved process cycle control of the present invention.

By operation in accordance with the present invention the temperature profile of the treating chamber corresponds to the curve depicted in FIG. 3.

At the start of the initial cycle, the treating chamber will be at about the same temperature level as in the conventional system (about −50° F.) (−46° C.). At the beginning of the cycle while refrigerant is introduced, in batch operation the throwing wheels preferably are also started rotating without introduction of impact medium. The rotation of the throwing wheels during the chamber cooldown period effects a recycling of the gaseous refrigerant and the forced convection increases the heat transfer coefficient and thus the rate of heat transfer at the surface of the workpiece is also increased. The cooldown of the treating chamber is permitted to continue until a preset very low temperature level is reached (setpoint #1) considerably below the glass transition temperature. As illustrated by the curve in FIG. 3, the chamber is cooled down to about minus 200° F. (line F) (−129° C.) at which level a short timed prechill period is initiated. During the prechill period the chamber temperature is controlled to maintain a constant level (line F). At the expiration of the fixed time for the prechill, blasting media is first introduced into the throwing wheels.

Since, in accordance with the invention, the set time period for prechill does not begin to run until the preset low temperature is reached in the treating chamber, there is no difference in the operation on repeated consecutive cycles. As seen in FIG. 3, the sixth cycle may begin with the chamber at a lower temperature than that prevailing at the start of the first cycle. This merely shortens the time needed to reach the preset temperature level indicated by line F. The workpieces will be supercooled at the time these are first contacted with the blasting media.

When the fixed prechill time period is completed a "media blast timer" and a "cycle temp timer" are energized. The temperature level controller now shifts to a second setpoint at a substantially warmer temperature (Setpoint #2).

When the chamber reaches the temperature level fixed by setpoint #2, the temperature controller will maintain that temperature level by activating the refrigerant supply valve accordingly. The operation will continue at the attained constant temperature level (setpoint #2) until the expiration of the fixed time period, designated "timed cycle temp" (line H), at the expiration of which the refrigerant supply valve will close thus discontinuing the introduction of refrigerant into the treating chamber. The bombardment of the workpieces with impact media will continue for an additional preset time period as indicated by dimension line G, at the conclusion of which the operating cycle is completed and automatically stopped. During the said additional time period following the discontinued flow of refrigerant, the temperature of the treating vessel is permitted to rise above that of setpoint #2. A short time thereafter the chamber door may be opened and the treated products unloaded; workpieces can then be introduced into the chamber to start the next cycle.

By operation in accordance with the present invention the problem of a progressive and variable chamber cooldown time is overcome by initiating the timed prechill period when the treating chamber reaches the preset temperature for the first time. In a prototype operation in accordance with the invention, the chamber cooldown time for minus 50° F. to minus 200° F. (−46° C. to −129° C.) was 3.5 minutes. After six successive operating cycles, the initial chamber temperature cooled down to minus 70° F. (−57° C.). The chamber cooldown time from minus 70° F. to minus 200° F. was thus decreased to 2.9 minutes. Although the cooldown time is significantly shorter, the change in cooling of the coated article is negligible because the differential time is at the relatively warm temperature of minus 50° to minus 70° F. (see FIG. 3).

To maximize the effectiveness of the coating removal process, it is necessary to maximize the thermal shock to the coating. The maximum thermal shock produces the greatest shear stress at the bonding interface between the layers of coating and the metallic body of the coated article. The invention attains these desired objectives by utilizing the maximum temperature differential between the coating and the chamber and by increasing the heat transfer coefficient at the surface of the coating. Setpoint #1 of the temperature controller is set at the lowest practical temperature (usually about minus 200° F.) that can be attained within the equipment. The heat transfer coefficient is increased by operating the throwing wheels during the chamber cooldown and the prechill time periods. The recycled cold gas produces forced convection heat transfer thereby increasing the heat transfer rate at the surface of the coated article. Thus, the combination of a very low chamber temperature and increased heat transfer coefficient produces the most effective coating removal process.

During the media blast period, the process control shifts to a substantially warmer setpoint that is just below the embrittlement temperature of the coating, which may be in order of about 25° to 100° F. above the first set point. This maintains the coating in a fragile condition as it is being impacted by high velocity media. The warmer setpoint #2 is employed to minimize the consumption of LIN in the coating removal process.

The blasting period to be employed will depend upon the thickness and nature of the coatings to be removed. In typical operation, the end of the blasting period and the termination of a cycle is indicated by a light or other signal, at which time the cleaned articles are ready for removal from the treating chamber. Opening of the door at such time may be manually controlled by the operator or set to open automatically at a short period following termination of the cycles. Once the door has been closed, the cycle of operations within the chamber preferably is initiated automatically by an appropriate relay system.

For most articles to be decoated, employing the process of the invention and fixing setpoint #1 at about −200° F. when using LIN as refrigerant, a complete cycle will typically take from 5 to 15 minutes after completion of the sixth cycle. The first cycle may require a total cycle of 15 to 25 minutes. Of the total cycle time (after six cycles) employed per cycle, about 20 to 40% of the time will be required to cooldown the treating chamber from the temperature prevailing at the initiation of the cycle to the setpoint #1 level. The timed prechill period will be fixed at 4 to 12% of the total cycle time. During the remaining 48 to 76% of the total cycle period, or for about 3 to 11 minutes, the articles will be subjectd to bombardment by the blasting media.

Summarized below are the important differences in control of the decoating process by the system of the invention over that of known conventional systems, whereby the problems heretofore encountered are overcome by the invention and more efficient decoating consistently realized:

1. In the conventional process control of the timed prechill period is initiated at the start of the cycle. Since there are progressive and variable fluctuations in the cooldown time, the coated article is exposed to a varying time-temperature profile producing erratic and inconsistent decoating results. By the control process of the invention, reliably uniform decoating is achieved by initiating the timed prechill period only after the treating chamber reaches the preset lowest operating temperature level (setpoint #1) for the first time.

2. The conventional process control operates at a single, constant temperature during both the prechill and media blast periods. In contrast thereto, by the process control of the invention, the system operates at a very low temperature during the prechill period and shifts to a much warmer temperature during the media blast period. The warmer temperature during the media blast period provides significant savings in refrigerant required for the operation.

3. In the conventional process the throwing wheels are not operated during the prechill period which includes the chamber cooldown. In the present invention the forced convection produced by operation of the throwing wheels during the chamber cooldown and prechill time periods is beneficially utilized to achieve a higher heat transfer coefficient at the surface of the coated article.

A specific example for a paint hanger that was successfully decoated is listed below.

1. Chamber temperature at the start of the cycle = −50° F.
2. Cooldown to setpoint #1 required 3.5 min.
3. Setpoint #1 temperature = −200° F.
4. Timed prechill period = 0.5 min.
5. Setpoint #2 temperature = −125° F.
6. Timed cycle temperature = 4.0 min.
7. Timed media blast 6.0 minutes.
8. Total cycle time = 10.0 minutes.

The paint hanger was coated with multiple layers of high solids polyester paint, approximately ⅛" thick. The coating was completely removed by the end of the cycle. The paint hanger is a welded assembly of ⅜" diameter rod, 26"×27"×5", weighing 5.8 lbs.

What is claimed is:

1. In a process for removal of bonded coatings from articles by chilling the articles in a closed treating chamber to effect embrittlement of the coatings thereon and subjecting the chilled articles in said chamber to high velocity impact by blasting media centrifugally hurled thereon by a rotating bladed impeller, the improvement which comprises the cycle sequence:

(a) initiating the process cycle by subjecting the coated articles to a cooldown stage in an initial environment of cryogenic fluid until a preset lowest temperature level is attained within said initial environment;

(b) continuing exposure of said articles at said first preset temperature level for a fixed present time period to assure pre-chilling of said articles to below embrittlement temperature of the coatings thereon;

(c) at the expiration of said pre-chilling time period, initiating impact of the articles with the blasting media;

(d) while continuing said impact, subjecting said articles to a controlled warming temperature environment until the warming environment reaches a second preset temperature level and when the second preset temperature level is attained continuing said impact at substantially said second preset temperature level for the remainder of a fixed time period measured from the time of initiation of impact with the blasting media;

(e) at the expiration of the remainder of said last-mentioned fixed time period, discontinuing continuous injection of cryogenic fluid into said cryogenic environment while maintaining exposure of said articles to temperatures proximate that of said second preset temperature while continuing impact with blasting media to the end of said treating cycle;

(f) and thereafter discharging the thus treated decoated articles from the treating chamber.

2. The improvement as defined in claim 1 wherein said first preset temperature level is no higher than −150° F.

3. The improvement as defined in claim 1 wherein said second preset temperature level is in the range of 25° to 100° F. above said first preset temperature level, but below the embrittlement temperature of the coatings on said articles.

4. The improvement as defined in claim 3 wherein said first preset temperature level is no higher than −150° F.

5. The improvement as defined in claim 1 wherein the complete process cycle is carried out in 5 to 15 minutes and said impact with blasting media comprises 40 to 76% of the complete cycle time.

6. The improvement as defined in claim 5 wherein during the period after initiating said impact, the temperature range to which said articles are exposed is permitted to rise to the second preset level and thereafter maintained substantially constant at said second level until exposure of the articles to cryogenic fluid is discontinued.

7. The improvement as defined in claim 1 wherein the process cycle is carried out in batch mode while said coated articles are maintained at a single treating station.

8. The improvement as defined in claim 7 wherein during the initial cooldown, stage (a) said bladed impeller is rotated in the absence of blasting media.

9. The improvement as defined in claim 7 wherein during the initial cooldown stage (a) said bladed impeller is rotated in the absence of blasting media to induce forced convection of cryogenic fluid and wherein after initiating impact of the articles with blasting media, such impact is continued for a fixed preset time period marking the termination of the process cycle.

10. The improvement as defined in claim 7 wherein said first preset temperature level is at or below −150° F. and said second preset temperature level is in the range of 25° to 100° F. above said first preset temperature level, but below the embrittlement temperature of the coatings on said articles.

11. The improvement as defined in claim 7 wherein the complete process cycle is carried out in about 5 to 15 minutes and said impact with blasting media comprises 40 to 75% of the complete cycle time.

12. The improvement as defined in claim 7 wherein during said initial cooldown stage (a) and during said prechill time (b) the bladed impeller is rotated in the absence of blasting media fed thereto and after initiating impact of the coated articles with blasting media said impact is continued for about 3 to 11 minutes, said initiation of such impact being begun when the treating environment is at a temperature of at least −150° F. or below and wherein exposure of the articles to cryogenic fluid is continued for 2 to 8 minutes after said initiation of impact.

13. The improvement as defined in claim 12 wherein during the period after initiating said impact, the temperature in said chamber is permitted to rise to the second preset level of −75° to −150° F. and is controllably maintained substantially constant at said second preset level until exposure of the coated articles to cryogenic fluid is discontinued.

14. The improvement as defined in claim 7 wherein during the process cycle, the articles being treated are initially exposed during the cooldown stage to a progressively decreasing temperature environment until said first preset lowest temperature level is attained in said environment, then said articles are maintained in an environment for a fixed time period at said first preset temperature level, following which fixed time period the articles are subjected to impact with blasting media while exposed to a progressively rising temperature environment for an unmeasured time period until said second preset temperature level is reached and then maintained at said second temperature level environment for a fixed time period measured from the time of initiation of said impact, at the expiration of which last stated measured time period introduction of cryogenic fluid to said chamber is discontinued.

* * * * *